US009308625B2

(12) United States Patent
Wu

(10) Patent No.: US 9,308,625 B2
(45) Date of Patent: Apr. 12, 2016

(54) KNIFE SHARPENER

(71) Applicant: Shih-Piao Wu, Changhua (TW)

(72) Inventor: Shih-Piao Wu, Changhua (TW)

(73) Assignee: Jiin Haur Industrial Co. Ltd., Changhua (TW)

( * ) Notice: Subject to any disclaimer, the term of this patent is extended or adjusted under 35 U.S.C. 154(b) by 0 days.

(21) Appl. No.: 14/242,801

(22) Filed: Apr. 1, 2014

(65) Prior Publication Data

US 2015/0273663 A1 Oct. 1, 2015

(51) Int. Cl.
*B24D 15/08* (2006.01)
*B24D 15/06* (2006.01)

(52) U.S. Cl.
CPC ..... *B24D 15/081* (2013.01); *B24D 15/065* (2013.01)

(58) Field of Classification Search
CPC ..... B24D 15/065; B24D 15/081; B24B 3/54
USPC ..... 451/344, 349, 312, 319, 321
See application file for complete search history.

(56) References Cited

U.S. PATENT DOCUMENTS 2,432,231 A * 12/1947 Elphee ..... 451/555
7,153,200 B1 * 12/2006 Wu ..... 451/344
2012/0264358 A1 * 10/2012 Wu ..... 451/344

* cited by examiner

*Primary Examiner* — Monica Carter
*Assistant Examiner* — Lauren Beronja
(74) *Attorney, Agent, or Firm* — Che-Yang Chen; Law Office of Michael Chen

(57) ABSTRACT

A knife sharpener may include a base, a securing unit and two grinding blades. One end of the base has a suction device and the other end thereof has a connecting hole. A receiving space is formed in the base and a screw hole is formed in the receiving space. The securing unit has a locking hole, a bolt passing through the locking hole to secure the securing unit at the screw hole of the base, and a restricting portion formed toward the direction of the locking hole. Two grinding blades are crossly disposed at the restricting portion of the securing unit, and a sharp portion of the grinding blade passes through the connecting hole, so said two grinding blades are protruding from the base to sharpen a knife between two grinding blades.

5 Claims, 4 Drawing Sheets

KNIFE SHARPENER

FIELD OF THE INVENTION

This invention relates to a knife sharpener, and more particularly to a knife sharpener with a suction base that can be easily assembled.

BACKGROUND OF THE INVENTION

In general, knifes become blunt after being used, and a grinding stone is usually used to sharpened the knives. Conventional grinding stones are heavy and not easy to store, and when in use, the user has to hold the grinding stone, so the chance to injure the user is high. Also, when during the grinding process, the user has to adjust the grinding angle to achieve a better result. Therefore, there remains a need for a new and improved knife sharpener to overcome the problems stated above.

SUMMARY OF THE INVENTION

In the present invention, a knife sharpener may include a base, a suction device, a securing unit and two grinding blades. One end of the base has the suction device and the other end thereof has a connecting hole, and a receiving space is formed in the base. A positioning block is protrudingly formed in the receiving space and a screw hole is formed on the positioning block in the receiving space. Two parallel recessed potions are formed on an outer surface of the base and an opening communicating with the receiving space is disposed between two recessed portions. The suction device has a suction plate, a handle and a shaft. A rod is connected with a center portion of the suction plate and the suction plate covers the receiving space of the base. The rod is configured to plug at the opening, and two connecting portions extend from the handle. The connecting portions are used to engage with the recessed portions, and the shaft is used to simultaneously and pivotally connect the connecting portions and the rod, so that the handle can drive the rod and suction plate to generate a suction effect. Also, a stopping block is protrudingly formed at the connecting portion to support and secure the recessed portions of the base. The securing unit has a locking hole, and a bolt passes through the locking hole to secure the securing unit at the screw hole of the base. A positioning slot is formed at the locking hole of the securing unit, and the positioning slot is used to engage with the positioning block to connect the base and the securing unit. A restricting portion is formed toward the direction of the locking hole. Two grinding blades are crossly disposed at the restricting portion of the securing unit, and a sharp portion of the grinding blade passes through the connecting hole. An engaging trough is formed toward the direction of the connecting hole in the receiving space, and the engaging trough engages with the restricting portion to secure the grinding blades. Two covering portions are protrudingly formed on one side of the connecting hole, so the sharp portions of the grinding blades can abut the covering portions and can be protected. The grinding blades can further protrude from the base and the grinding process can be conducted between two grinding blades.

The main object of the present invention is that one end of the base has the suction device and the other end has the connecting hole, from which the grinding blades can protrude out, and the suction device can be used to quickly secure the base so the grinding blades can be readily used. More importantly, the user does not have to hold the base, which helps the user efficiently sharpen the knives and reduces the chance to injure the user's hand The second object of the present invention is that the screw hole is formed in the receiving space, so the securing unit can be directly secured at the screw hole with the bolt. And the positioning slot of the securing unit is provided for the grinding blades, so the grinding blades can protrude from the connecting hole to complete the assembly process.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
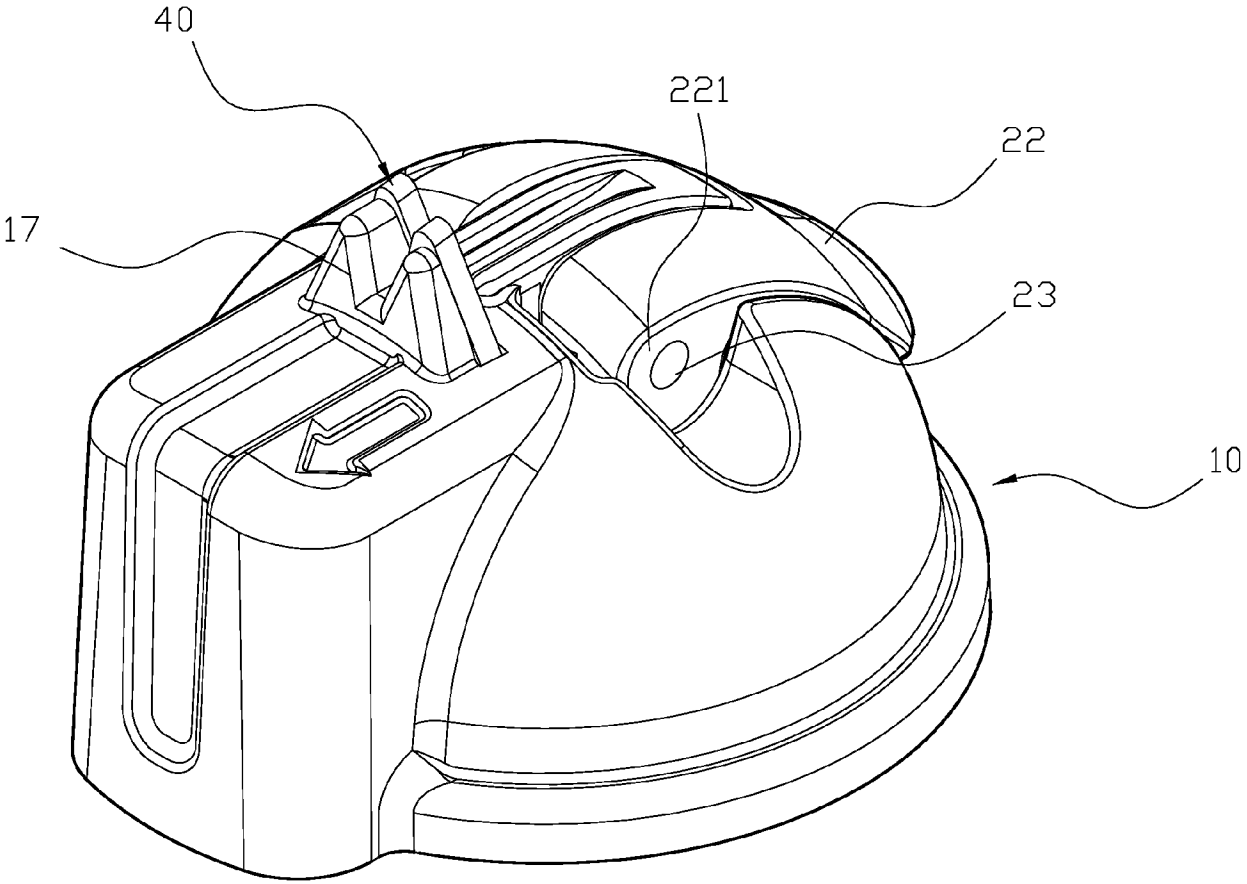
FIG. 1 illustrates a three-dimensional view of the present invention.
Figure 2:
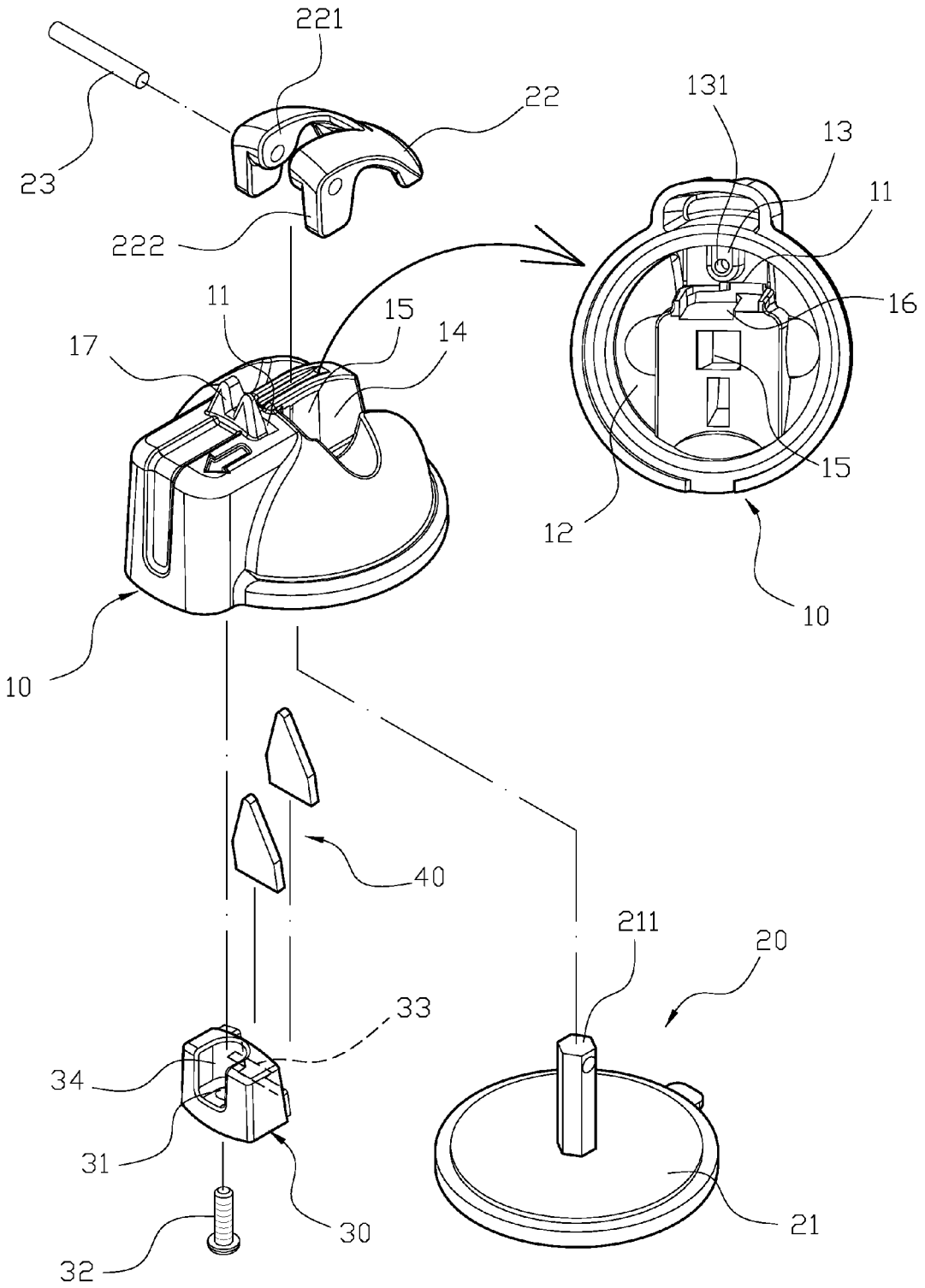
FIG. 2 illustrates an exploded view of the present invention.

In order to further understand the goal, characteristics and effect of the present invention, a number of embodiments along with the drawings are illustrated as following:

Referring to FIGS. 1 to 2, a knife sharpener may include a base 10, a suction device 20, a securing unit 30 and two grinding blades 40. One end of the base 10 has the suction device 20 and the other end thereof has a connecting hole 11, and a receiving space 12 is formed in the base 10. A positioning block 13 is protrudingly formed in the receiving space 12 and a screw hole 131 is formed on the positioning block 13 in the receiving space 12. Two parallel recessed potions 14 are formed on an outer surface of the base 10 and an opening 15 communicating with the receiving space 12 is disposed between two recessed portions 14. The suction device 20 has a suction plate 21, a handle 22 and a shaft 23. A rod 211 is connected with a center portion of the suction plate 21 and the suction plate 21 covers the receiving space 12 of the base 10. The rod 211 is configured to plug at the opening 15, and two connecting portions 221 extend from the handle 22. The connecting portions 221 are used to engage with the recessed portions 14, and the shaft 23 is used to simultaneously and pivotally connect the connecting portions 221 and the rod 211, so that the handle 22 can drive the rod 211 and suction plate 211 to generate a suction effect. Also, a stopping block 222 is protrudingly formed at the connecting portion 221 to support and secure the recessed portions 14 of the base 10. The securing unit 30 has a locking hole 31, and a bolt 32 passes through the locking hole 31 to secure the securing unit 30 at the screw hole 131 of the base 10. A positioning slot 33 is formed at the locking hole 31 of the securing unit 30, and the positioning slot 33 is used to engage with the positioning block 13 to connect the base 10 and the securing unit 30. A restricting portion 34 is formed toward the direction of the locking hole 31. Two grinding blades 40 are crossly disposed at the restricting portion 34 of the securing unit 30, and a sharp portion of the grinding blade 40 passes through the connecting hole 11. An engaging trough 16 is formed toward the direction of the connecting hole 11 in the receiving space 12, and the engaging trough 16 engages with the restricting portion 34 to secure the grinding blades 40. Two covering portions 17 are protrudingly formed on one side of the connecting hole 11, so the sharp portions of the grinding blades 40 can abut the covering portions 17 and can be protected. The grinding blades 40 can further protrude from the base 10 and the knife sharpening process can be conducted between two grinding blades 40.

Figure 3:
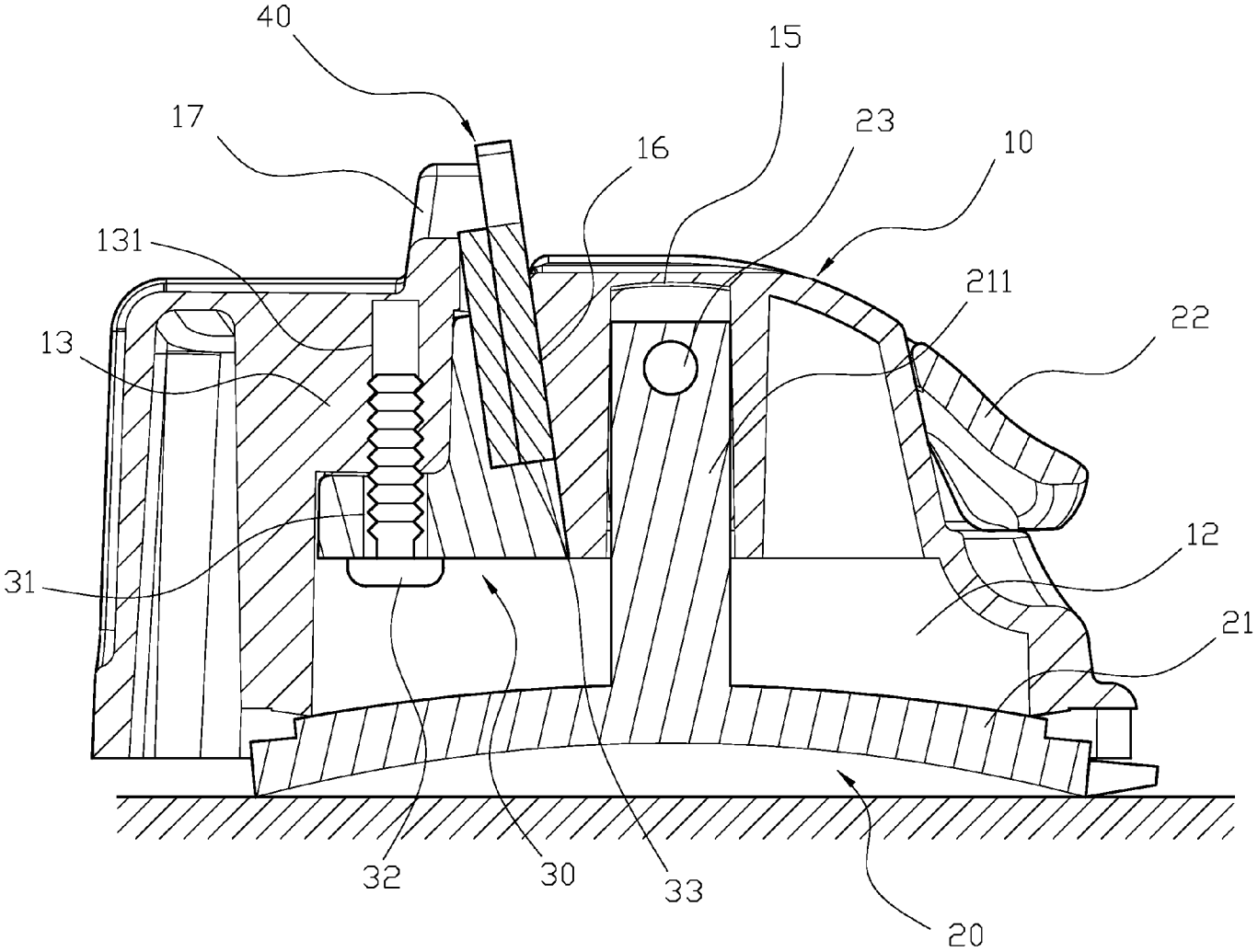
FIG. 3 illustrates a sectional view of the present invention.
Figure 4:
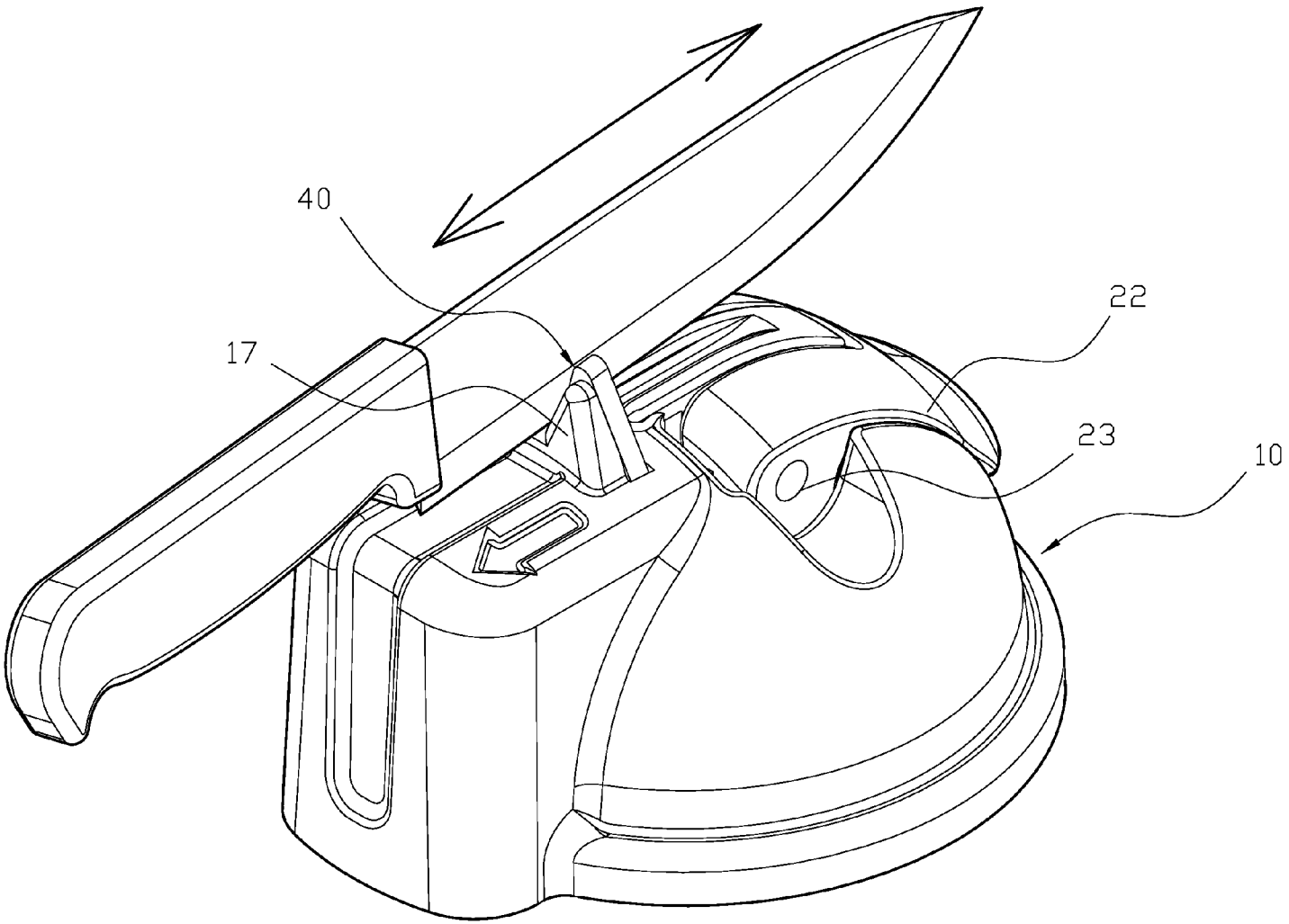
FIG. 4 illustrates a schematic view of the present invention when in use.

When in use, referring to FIGS. 2 to 4, the grinding blades 40 are disposed in the positioning slot 33 of the securing unit 30, and the securing unit 30 is then disposed in the receiving space 12. The restricting portion 34 of the securing unit 30 engages with the positioning block 13 of the base 10, and the bolt 32 can be inserted into the locking hole 31 and screw hole 131 to securely connect the securing unit 30 and the base 10. Meanwhile, the grinding blades 40 are clamped between the positioning slot 33 and the engaging trough 16, and the sharp portions of the grinding blades 40 can protrude from the connecting hole 11 of the base 10 and abut the covering portions 17. Furthermore, the suction plate 21 is disposed in the receiving space 12 of the base 10, and the rod 211 plugs into the opening 15. The connecting portions 221 are used to engage with the recessed portions 14, and the shaft 23 is pivotally connected with the connecting portion 221 and the rod 211 to completely assemble the knife sharpener in the present invention. The base 10 can be secured on any flat surface with the suction device 20, the surface including table surface, wall surface, cabinet surface, refrigerator surface, etc. More specifically, the suction device 20 can be used to attach to any flat surface through the suction plate 21, and when the handle 22 is rotated, the stopping block 222 can push the base 10 to pull the rod 211, and the rod 211 can further drive the suction plate 21 to make the base 10 to shrink inside to secure the base 10 with vacuum suction. When the knife sharpener is in use, a knife's blade can be disposed between two grinding blades 40 that are crossly disposed for a predetermined angle, so the knife can repeatedly be sharpened in a vertical manner and the user does not have to adjust the sharpening angle between the knife and the grinding blades 40.

According to the embodiments discussed above, the present invention is advantageous because (i) one end of the base 10 has the suction device 20 and the other end has the connecting hole 11, from which the grinding blades 40 can protrude out, and the suction device 20 can be used to quickly secure the base 10 so the grinding blades 40 can be readily used. More importantly, the user does not have to hold the base 10, which helps the user efficiently sharpen the knives and reduces the chance to injure the user's hand; and (ii) the screw hole 131 is formed in the receiving space 12, so the securing unit 30 can be directly secured at the screw hole 131 with the bolt 32. And the positioning slot 33 of the securing unit 30 is provided for the grinding blades 40, so the grinding blades 40 can protrude from the connecting hole 11 to complete the assembly process.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A knife sharpener comprising:

a base, one end of which having a suction device and the other end thereof having a connecting hole, a receiving space formed in the base and a screw hole formed in the receiving space, and two parallel recessed potions are formed on an outer surface of the base and an opening communicating with the receiving space disposed between two recessed portions;

a securing unit having a locking hole, a bolt passing through the locking hole to secure the securing unit at the screw hole of the base, and a restricting portion formed toward the direction of the locking hole; and two grinding blades crossly disposed at the restricting portion of the securing unit, and a sharp portion of the grinding blade passing through the connecting hole, so said two grinding blades protruding from the base to sharpen a knife between the two grinding blades, wherein the suction device has a suction, plate, a handle and a shaft, and a rod configured to plug at the opening is connected with a center portion of the suction plate, and the handle has two connection portions which is configured to dispose at said two recessed portions, and the shaft is used to simultaneously and pivotally connect the connecting portions and the rod, so that the handle is configured to drive the rod and suction plate to generate a suction effect.

2. The knife sharpener of claim 1, wherein a stopping block is protrudingly formed at the connecting portion to support and secure the recessed portions of the base.

3. The knife sharpener of claim 1, wherein two covering portions are protrudingly formed on one side of the connecting hole, so the sharp portions of the grinding blades are configured to abut the covering portions.

4. The knife sharpener of claim 1, wherein a positioning block is protrudingly formed in the receiving space and the screw hole is formed on the positioning block, and a positioning slot is formed at the locking hole of the securing unit, and the positioning slot is used to engage with the positioning block to connect the base and the securing unit.

5. The knife sharpener of claim 1, wherein an engaging trough is formed toward the direction of the connecting hole in the receiving space, and the engaging trough engages with the restricting portion to secure the grinding blades.

* * * * *